US010204722B2

(12) United States Patent
Rinner et al.

(10) Patent No.: US 10,204,722 B2
(45) Date of Patent: Feb. 12, 2019

(54) ELECTRONIC COMPONENT AND METHOD FOR THE PRODUCTION THEREOF

(71) Applicant: EPCOS AG, Munich (DE)

(72) Inventors: Franz Rinner, Deutschlandsberg (AT); Yongli Wang, Frauental (AT)

(73) Assignee: EPCOS AG, München (DE)

( * ) Notice: Subject to any disclaimer, the term of this patent is extended or adjusted under 35 U.S.C. 154(b) by 0 days.

(21) Appl. No.: 15/312,503

(22) PCT Filed: May 18, 2015

(86) PCT No.: PCT/EP2015/060882

§ 371 (c)(1),
(2) Date: Nov. 18, 2016

(87) PCT Pub. No.: WO2015/177085

PCT Pub. Date: Nov. 26, 2015

(65) Prior Publication Data

US 2017/0092394 A1 Mar. 30, 2017

(30) Foreign Application Priority Data

May 19, 2014 (DE) ..... 10 2014 107 040

(51) Int. Cl.
*H01C 7/10* (2006.01)
*H01C 1/142* (2006.01)
(Continued)

(52) U.S. Cl.
CPC ..... *H01C 7/10* (2013.01); *H01C 1/14* (2013.01); *H01C 1/142* (2013.01); *H01C 7/102* (2013.01); *H01C 7/105* (2013.01); *H01C 17/00* (2013.01)

(58) Field of Classification Search
CPC ..... H01C 7/10; H01C 1/14; H01C 17/00
(Continued)

(56) References Cited

U.S. PATENT DOCUMENTS 2,959,504 A 11/1960 Ross et al.
4,157,527 A * 6/1979 Philipp ..... H01C 7/102 338/21

(Continued)

FOREIGN PATENT DOCUMENTS

CN 101010754 A 8/2007
DE 2832735 A1 2/1979

(Continued)

*Primary Examiner* — Kyung Lee
*Assistant Examiner* — Iman Malakooti
(74) *Attorney, Agent, or Firm* — Slater Matsil, LLP

(57) ABSTRACT

An electronic component and a method for producing an electrical component are disclosed. In an embodiment, the electronic component includes a functional body having a first surface and a second surface, wherein the second surface faces away from the first surface, and a contact electrically linked to the first surface, the contact having an edge region and a central region, wherein the functional body has a first electrical resistance between the first surface and the second surface in a first functional body portion, which overlaps the edge region of the contact as viewed in a plan view of the electronic component, that is greater than a second electrical resistance between the first surface and the second surface in a second functional body portion, which overlaps the central region of the contact as viewed in a plan view of the electronic component.

16 Claims, 7 Drawing Sheets

(51) Int. Cl.

| | |
|---|---|
| ***H01C 7/102*** | (2006.01) |
| ***H01C 7/105*** | (2006.01) |
| ***H01C 1/14*** | (2006.01) |
| ***H01C 17/00*** | (2006.01) |

(58) Field of Classification Search
USPC ..... 338/20
See application file for complete search history.

(56) References Cited

U.S. PATENT DOCUMENTS

| | | | | | |
|---|---|---|---|---|---|
| 4,364,021 | A | * | 12/1982 | Levinson | H01C 7/102<br>338/20 |
| 5,414,403 | A | * | 5/1995 | Greuter | H01C 7/027<br>338/22 R |
| 5,594,613 | A | * | 1/1997 | Woodworth | H01C 7/12<br>361/117 |
| 2008/0094169 | A1 | | 4/2008 | Kinoshita et al. | |

FOREIGN PATENT DOCUMENTS

| | | | |
|---|---|---|---|
| DE | 3405834 | A1 | 8/1985 |
| DE | 4221309 | A1 | 1/1994 |
| EP | 1798741 | A1 | 6/2007 |
| JP | S5074444 | U | 6/1975 |
| JP | S56115501 | A | 9/1981 |
| JP | S6329902 | A | 2/1988 |
| JP | H05335114 | A | 12/1993 |
| JP | H06310306 | A | 11/1994 |
| JP | 2000058307 | A | 2/2000 |
| JP | 2007173313 | A | 7/2007 |
| JP | 2007251102 | A | 9/2007 |
| JP | 2007329178 | A | 12/2007 |

* cited by examiner

Fig. 6

| | (1) Original state | (2) Thick edge | (3) Altered material at the edge | (4) Both |
|---|---|---|---|---|
| Voltage at the pulse maximum (30 A) | 2130 V | 2178 V | 2184 V | 2230 V |
| Current density at the pulse maximum (30 A) | 492 A/mm² | 431 A/mm² | 412 A/mm² | 352 A/mm² |
| Max. temperature at the end of the pulse | 1546°C | 1088°C | 1177°C | 796°C |

ELECTRONIC COMPONENT AND METHOD FOR THE PRODUCTION THEREOF

This patent application is a national phase filing under section 371 of PCT/EP2015/060882, filed May 18, 2015, which claims the priority of German patent application 10 2014 107 040.2, filed May 19, 2014, each of which is incorporated herein by reference in its entirety.

TECHNICAL FIELD

The present invention relates to an electronic component, for example a varistor component, and a method for the production thereof.

SUMMARY OF THE INVENTION

Embodiments of the invention provide an improved electronic component, in particular a more flexibly usable and/or more robust electronic component.

In an embodiment, an electronic component comprises a functional body. The functional body expediently constitutes the functional element of the electronic component. Furthermore, the electronic component comprises a contact which is electrically linked to a first surface of the functional body or contacts the latter. The contact can be an electrical contact layer and/or a metallization or some other contacting. Via the contact the functional body is expediently contacted and/or electrically linked to further terminals, for example an external electrode of the electronic component.

The surface is preferably a first surface, for example a first main surface of the functional body. The contact has an edge region and a central region. Furthermore, the functional body is configured in such a way that the electrical resistance of the functional body between the first surface and a second surface or main surfaces of the functional body, said second surface or main surface facing away from the first surface, in a first functional body portion, which overlaps the edge region as viewed in a plan view of the electronic component, in particular of the first surface, is greater than in a second functional body portion, which overlaps the central region of the contact. The first and second functional body portions are preferably radial portions of the functional body.

The central region of the contact preferably denotes an inner and/or middle region of the contact, while the edge region preferably denotes or defines an outer edge of the contact.

Preferably, the contact is electrically linked both to the first and to the second functional body portion. The first functional body portion preferably denotes an outer or edge portion of the functional body. By contrast, the second functional body portion preferably denotes an inner or central portion of the functional body. The second functional body portion and the central region are preferably congruent—as viewed in a plan view of the electronic component.

Preferably, said contact is a first contact. Expediently, the electronic component additionally comprises a second contact which is electrically linked to the second surface of the functional body or contacts the latter. The second contact is preferably formed analogously to the first contact and arranged in relation to the second surface in the same way as the first contact is arranged in relation to the first surface. The first and second contacts can be arranged symmetrically for example relative to a longitudinal axis of the electronic component. Preferably, the electronic component and/or the functional body are/is arranged in a disk-shaped fashion and at least largely rotationally symmetrically relative to the longitudinal axis.

In the case of a disk-type varistor as electronic component, preferably a respective contact is provided or arranged at a top side and at an underside of the disk for the electrical linking or contacting.

Preferably, the first and second contacts are arranged congruently for example as viewed in a plan view of the electronic component.

By way of example, the functional body is preferably arranged directly or immediately between the contacts, as viewed in a sectional view along the longitudinal axis.

In one preferred configuration, the electronic component is a varistor component. Varistor components are preferably used as overvoltage protection. In accordance with this configuration, the functional body is expediently configured in such a way that it constitutes the functional element of the varistor component. In this regard, the functional body can comprise a polycrystalline, sintered, material.

In one preferred configuration, the electronic component is a disk-type or block varistor.

In one configuration, the first functional body portion extends at least partly circumferentially around the second functional body portion as viewed in a plan view of the electronic component. Preferably, the first functional body portion completely encloses or extends circumferentially around the second functional body portion.

In one configuration, the functional body is configured in such a way as to decrease or reduce the electric current density in the first functional body portion, in particular at a contact location of the first functional body portion and of the edge region of the contact or between the first functional body portion and the edge region, during the operation of the electronic component and/or in the case of a current flow in the functional body. Preferably, the electric current density in this case is decreased or reduced in comparison with a conventional electronic component or a component from the prior art.

Particularly at said contact location, the electric current density and temperature loading associated therewith may be particularly high for example during the operation of the electronic component. The cause of this may be an edge effect established during the operation of the electronic component.

The electronic component presented advantageously makes it possible, during operation, to reduce or decrease the evolution of heat, for example as a result of joule heat that arises, in the first functional body portion, since generally less heat arises as a result of an increased electrical resistance and thus decreased electric current density. As a result, the electronic component simultaneously becomes thermally stabler and more diversely usable. Furthermore, the lifetime of the electronic component can advantageously be increased.

High temperatures in the functional element can considerably restrict the lifetime and/or the operational range of the electronic component particularly in the case of a varistor component. Particularly for varistor components, if an overvoltage is present for a relatively long time, the thermal loadings described can even lead to the destruction of the component. That can be counteracted by the above-described configuration of the functional body to the effect that the first functional body portion has a greater electrical resistance than the second functional body portion, since the edge effect described is attenuated as a result.

In one preferred configuration, the surface area of the second functional body portion as viewed in a plan view of the electronic component is greater than the surface area of the first functional body portion. What can be achieved by this configuration is, in particular, that the electrical resistance of the functional body of the electronic component between the first and second surfaces is or remains defined overall by the second functional body portion. As a result, the electrical properties, in the case of a varistor component for example the varistor voltage, in turn remain substantially unchanged. By way of example, the surface area of the second functional body portion is double the magnitude, three times the magnitude or ten times the magnitude of the surface area of the first functional body portion.

In one preferred configuration, the functional body has in the first functional body portion a contact-free region. The contact-free region is preferably an outer radial portion of the functional body. The contact-free region is accordingly preferably arranged marginally relative to the functional body. There is preferably no contact present in the contact-free region. An improved contacting of the functional body can advantageously be achieved by means of this configuration. In particular, it is possible to prevent or restrict electrical flashovers at the margin, edge region or at an edge of the functional body. Preferably, the contact-free region or an edge thereof has a course without any bends as viewed in a plan view of the electronic component. The configuration without any bends makes it possible in particular in turn to decrease or minimize an edge length or edge area of the contacting and thus to prevent or restrict the production of "hotspots" in which particularly high electrical fields, thermomechanical stresses and/or thermal, mechanical or electrical loadings occur.

In one preferred configuration, the thickness of the functional body in the first functional body portion is greater than the thickness of the functional body in the second functional body portion. Preferably, the thickness of the first functional body portion and also the thickness of the second functional body portion are at least predominantly constant or approximately constant. This configuration advantageously makes it possible to specify a means for increasing the electrical resistance in the first functional body portion, as a result of which it is possible to decrease the electric current density and thus the temperature loading in the first functional body portion during the operation of the electronic component. In other words, the electrical resistance of the first functional body portion is increased as a result of the greater distance between the contacts or surfaces in the first functional body portion, or as a result of the greater path length along the thickness, in contrast to the second functional body portion, wherein for the same electrical voltage present at the electronic component, for example, it is possible to reduce the current loading and thus the overheating or temperature loading in the first functional body portion.

The described thickness in the present case preferably extends along the abovementioned longitudinal axis of the electronic component.

Preferably, the thickness of the functional body is increased only at one side or main surface of the electronic component and/or of the functional body, whereas at the other side of the electronic component the areas of the first functional body portion and of the second functional body portion of the functional body are planar and/or lie in one plane. Alternatively, the functional body can be configured in such a way that for example a top side and an underside of the first functional body portion are not arranged in one plane relative to a top side and an underside, respectively, of the second functional body portion.

In one preferred configuration, the thickness of the functional body in the first functional body portion is 5% to 15% greater than the thickness of the functional body in the second functional body portion. Particularly preferably, the thickness of the functional body in the first functional body portion is at least 10% greater than the thickness of the second functional body portion. Alternatively, said thickness can for example also be increased by more than 15%. The effect of increasing the thickness with regard to the electrical resistance is qualitatively the same here.

In one preferred configuration, the radial extent of the first functional body portion is between the thickness and twice the thickness of the functional body in the first functional body portion.

In one preferred configuration, the material properties of the functional body in the first functional body portion are different from those in the second functional body portion. What can expediently be achieved by this configuration is that the electrical resistance in the first functional body portion is increased in comparison with the second functional body portion.

In one preferred configuration, the functional body is configured in such a way that the first functional body portion has a greater electrical resistivity in comparison with the second functional body portion. As a result of this configuration, as an alternative or in addition to the configuration in which only the thickness of the first functional body portion is increased, it is possible to reduce or decrease the current density in the first functional body portion during the operation of the electronic component. Corresponding differences in the material properties can preferably be produced or formed during the method for producing the electronic component and/or during a sintering of the functional body (see below). As a result of the greater electrical resistivity, it is possible, as already indicated above, in the first functional body portion with given current pulses advantageously to reduce the current densities and thus the temperature loadings particularly in the first functional body portion.

In one preferred configuration, the functional body comprises a sintered material.

In one preferred configuration, the contact is a first contact, wherein the electronic component additionally has a second contact which is electrically linked to the second surface of the functional body, and wherein the functional body is configured in such a way as to homogenize the electric current or current density distribution in the case of a current flow in the functional body between the contacts in the first and second functional body portions. This can mean that discrepancies or the variation of the electric current densities which are present for example during the operation of the electronic component and/or in the case of a current flow in the functional body are/is reduced. Preferably, the second contact has an edge region and a central region analogously to the first contact.

In one preferred configuration, the functional body is, preferably substantially, polycrystalline. In this sense the functional body can comprise a polycrystalline material for example as main constituent.

In one preferred configuration, the functional body comprises, for example as main constituent, a ceramic. The ceramic is preferably a sintered ceramic.

In one preferred configuration, the functional body is configured in such a way that it conducts electrically throughout between the first and second surfaces after the application of an electrical voltage above a characteristic threshold, for example the varistor voltage in the case of a varistor component, without the functional body having electrically insulating regions.

Furthermore, a method for producing the functional body for the electronic component described above is specified. The functional body and/or the electronic component are/is preferably producible or produced by means of the method described here. In particular, all features disclosed for the method can also relate to the functional body and/or the electronic component, and vice versa.

The method comprises providing a basic material for the functional body for the electronic component, and forming the functional body using the basic material in such a way that the electrical resistance of the functional body, measured between two opposite surfaces, that is to say the first and second surfaces mentioned above, in the first functional body portion is greater than in the second functional body portion.

In one preferred configuration of the method, this comprises providing the functional body with a respective contact at the opposite surfaces, wherein each contact, for example the first and second contacts mentioned above, is electrically linked to the first and second functional body portions.

In one preferred configuration of the method, the basic material has a more homogeneous material composition than the functional body. The material composition of the basic material is preferably substantially homogeneous, whereas the material composition of the functional body is inhomogeneous, particularly with respect to a comparison of the material compositions of the first and second functional body portions with one another and with regard to individual material constituents.

In one preferred configuration of the method, the basic material is formed with a greater thickness in the first functional body portion in comparison with the second functional body portion. This configuration advantageously makes it possible to increase the electrical resistance of the first functional body portion in comparison with the second functional body portion.

In one preferred configuration of the method, the basic material is sintered to form the functional body, in such a way that the electrical resistivity of the functional body in the first functional body portion is greater than in the second functional body portion. By way of example, the basic material is sintered for this purpose in such a way that crystal grains or corresponding grain sizes in the first functional body portion of the functional body are smaller or are formed smaller than in the second functional body portion. As a result of the smaller grain sizes or greater density of grain boundaries of the first functional body portion in comparison with the second functional body portion, the electrical resistivity of the functional body in the first functional body portion is expediently made greater than in the second functional body portion.

In one preferred configuration of the method, the material composition of the basic material is altered in a first portion thereof during sintering in order to form the first functional body portion. The first functional body portion is formed from the first portion of the basic material preferably by means of the sintering.

In one preferred configuration of the method, the basic material is exposed to a temperature gradient during sintering, wherein the basic material is not provided with material additives during sintering and preferably likewise before sintering. Preferably, no further material is added to the basic material here from outside, for example from outside the sintering furnace, during sintering. Preferably, the material composition of the basic material in the first functional body portion instead changes as a result of migration and/or diffusion processes of material constituents originally contained in the basic material.

In one preferred configuration, the basic material is provided with a dopant before sintering, which dopant diffuses into the basic material during sintering in order to form the first functional body portion. The dopant or the additional material is preferably applied to the basic material or the basic material is dipped into the dopant or a solution comprising the latter before sintering. The dopant can be yttrium oxide, for example $Y_2O_3$, or other rare earth metals or oxides thereof.

In one preferred configuration, the first functional body portion is formed in such a way that the maximum temperature which occurs in the first functional body portion under an electrical test pulse having a current intensity of 30 A with the pulse shape 8/20 is reduced by at least 500° C., for example in comparison with a conventional electronic component.

Furthermore, a method for producing an electronic component is specified which comprises the method steps of the abovementioned method for producing the functional body.

BRIEF DESCRIPTION OF THE DRAWINGS

Further advantages, advantageous configurations and expediences of the invention will become apparent from the following description of the exemplary embodiments in association with the figures.

FIG. 6 shows a table with values concerning the simulation of the operation of the electronic component.

Elements that are identical, of identical type and act identically are provided with identical reference signs in the figures. The figures and the size relationships of the elements illustrated in the figures among one another should not be regarded as to scale. Rather, individual elements may be illustrated with an exaggerated size in order to enable better illustration and/or in order to afford a better understanding.

DETAILED DESCRIPTION OF ILLUSTRATIVE EMBODIMENTS

Figure 1:
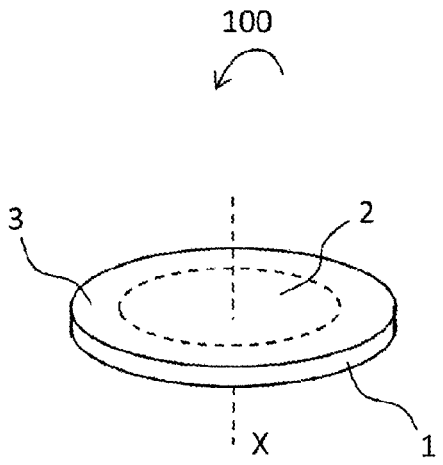
FIG. 1 shows a schematic perspective view of an electronic component.

FIG. 1 shows a schematic perspective view of an electronic component 100. The electronic component 100 is preferably a varistor component, in particular a disk-type or block varistor. Particularly preferably, the electronic component 100 is a disk-type varistor.

The electronic component 100 is configured in a disk-shaped fashion in accordance with FIG. 1 and has a longitudinal axis or axis X of symmetry that runs through the center of the disk. The electronic component is preferably at least approximately rotationally symmetrical relative to the longitudinal axis X. In accordance with FIG. 1, the electronic component furthermore has a disk-shaped functional body 1.

In the case of a varistor component, the functional body 1 preferably comprises a semiconductor material and/or a sintered ceramic, for example. Accordingly, the functional body 1 furthermore preferably comprises polycrystalline material, or material comprising grain boundaries and/or grains of differing electrical conductivity. As a functional component part of a varistor component, the functional body 1 is preferably formed in such a way that it can be switched from the electrically insulating state to the electrically conducting state after the application of an electrical voltage above the varistor voltage. The functional body 1 comprises a first functional body portion 3 and a second functional body portion 2. The first functional body portion 3 extends circumferentially around or encloses the second functional body portion 2 as viewed in a plan view of the electronic component 100 preferably at its outer edge and is preferably cohesively and/or integrally connected thereto in order to form the functional body 1. The boundary of the portions mentioned is indicated by the dashed line.

The electronic component, or the disk-type or block varistor, has for example a diameter of approximately 30 mm and a thickness of approximately 3 mm. The thickness mentioned preferably relates to the thickness of the second functional body portion 2 along the longitudinal axis.

In an alternative configuration (not explicitly illustrated) of the electronic component, the latter or a corresponding functional body has a rectangular shape. Accordingly, the electronic component according to the invention can be an angular block varistor, for example.

Figure 2:
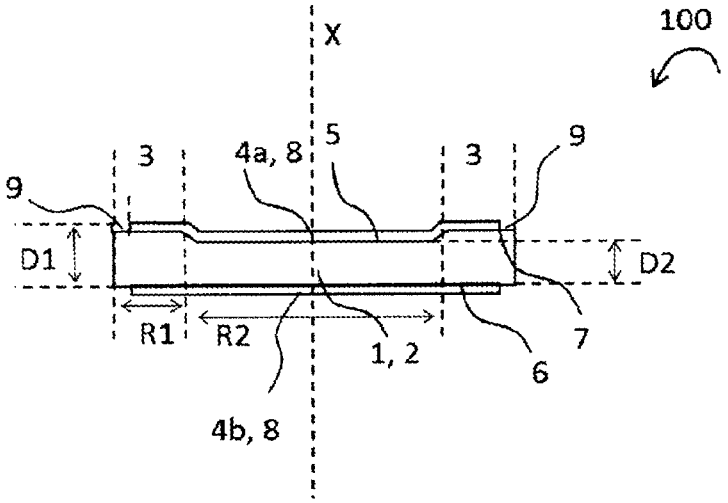
FIG. 2 shows a schematic sectional view of an electronic component according to the invention.

FIG. 2 shows a schematic sectional view of a configuration of the electronic component 100 according to the invention. FIG. 2 preferably shows a sectional view through the electronic component 100 in accordance with FIG. 1 along the longitudinal axis X. It is furthermore evident that the functional body 1 has a thickness D1 in its first functional body portion 3. In the second functional body portion 2, the functional body 1 has a thickness D2. The thickness D2 is less than the thickness D1. The thickness D1 can be for example 5%, 10% or 15% greater or even greater than the second thickness.

The functional body 1 furthermore has a first surface 5 and a second surface 6 facing away from the first surface 5. In accordance with FIG. 1, the second surface 6 is formed in a planar fashion, while the first surface 5 is non-planar as a result of the increase in the thickness D1 in the first functional body portion 3 in comparison with D2. Alternatively, the greater thickness D1 of the first functional body portion 3 in comparison with the second functional body portion 2 can also be realized in such a way that both surfaces 5, 6 in the first functional body portion 3 are elevated, that is to say non-planar overall, relative to the second functional body portion 2.

As illustrated in FIG. 2, the thickness of the functional body 1 can increase for example from the first to the second functional body portion (from the inner section toward the outer section) by way of an oblique profile (cf. likewise FIGS. 5A to 5D further below). Alternatively, an abrupt change in the thickness by way of a step in the profile of the thickness of the functional body 1 is likewise conceivable (not explicitly illustrated in the figures).

As a result of the greater thickness D1 of the first functional body portion 3 in comparison with the second functional body portion 2 (cf. D2 in FIG. 2), the electrical resistance of the functional body 1 between the first surface 5 and the second surface 6 in particular as a result of the increased path distance in the first functional body portion 3 according to the invention can be configured to be greater than in the second functional body portion 2.

The electronic component 100 furthermore has a first contact 4*a* which is electrically linked to the first surface 5. The first contact 4*a* is preferably linked both to the first functional body portion 3 and to the second functional body portion 2. The contact 4*a* in turn has an edge region 7 and a central region 8. Preferably, the edge region 7 encloses the central region 8.

Analogously, the electronic component has a second contact 4*b* which is linked to the first functional body portion 3 and the second functional body portion 2 at the second surface 6. In a manner corresponding to the first contact, the second contact 4*b* preferably has an edge region 7 and a central region 8. Preferably, the first and second contacts 4*a*, 4*b* are arranged congruently as viewed in a plan view of the electronic component 100.

The contacts 4*a*, 4*b* preferably contact the functional body 1. The contacts can be for example metallized electrodes, in particular metallic contact layers. Furthermore, the contacts 4*a*, 4*b* can be provided for an electrical linking or contacting of an external electrode (not explicitly illustrated) at the functional body 1.

If—in the case of a varistor component—an electrical voltage is applied between the contacts 4*a*, 4*b*, as long as the voltage is less than the characteristic varistor voltage between the contacts 4*a*, 4*b* preferably only a low leakage current flows. In the event of an overvoltage being applied to or between the contacts 4*a*, 4*b*, the functional body 1 expediently becomes electrically conducting in order, for example, to protect a further electrical component part against an overvoltage or an electrical voltage that damages the component part.

The first functional body portion 3 preferably overlaps the edge region 7 as viewed in a plan view of the electronic component 100, that is to say for example in a plan view of the surface 5. The second functional body portion 2 preferably overlaps the central region 8 as viewed in a plan view of the electronic component 100.

The configuration of the greater resistance of the first functional body portion 3 compared with the second functional body portion 2 advantageously makes it possible to decrease or reduce the electric current, or in particular the electric current density, occurring in the first functional body portion 3 during the operation of the electronic component 100. The reduced current loading simultaneously makes it possible to reduce the production of heat and thus the temperature loading in the first functional body portion.

The electronic component 100 according to the invention preferably has, apart from the thickness D1 of the first functional body portion 3, comparable dimensions relative to a conventional electronic component or an electronic component from the prior art. In particular, the contact areas, that is to say the areas in which the contacts 4*a*, 4*b* are linked to the functional body 1, are also dimensioned or configured similarly or comparably in this regard.

Particularly at the boundary or contact location of the abovementioned edge region 7 or edge of the contacts 4*a*, 4*b* with respect to the first functional body portion 3, the electric current density and temperature loading associated therewith for example during the operation of the electronic component may be particularly high as a result of an "edge effect". The edge effect can be caused by electric fields which, during the operation of the component 100, at or in the edge region 7 turn out to be greater than in the central region 8, for example.

Although the electric current density is reduced as a result of the greater distance between the contacts in the first functional body portion 3, further electrical properties of the electronic component 100 preferably remain unchanged and/or determined by the second functional body portion 2.

The surface area of the second functional body portion 2 is preferably greater than that of the first functional body portion 3. By way of example, the surface area of the second functional body portion 3 is double the magnitude, three times the magnitude or ten times the magnitude of the surface area of the first functional body portion 3. As a result, the electrical properties, for example the varistor voltage in the case of a varistor component, of the electronic component preferably remain independent of the configuration of the first functional body portion 3.

A radial extent of the first functional body portion 3 is identified by R1 in FIG. 2. Furthermore, a radial extent, in particular the diameter of the second functional body portion 2, is identified by R2. Preferably, the radial extent R1 is between the thickness and twice the thickness D1 of the functional body 1 in the first functional body portion 3.

Furthermore, in the first functional body portion 3 FIG. 2 illustrates a contact-free edge 9 of the functional body 1, in which the contacts 4*a*, 4*b* are not electrically linked to the functional body 1. The contact-free region 9 preferably denotes a radial outer portion of the functional body 1. In other words, at the outer edge of the electronic component 100 the contacts 4*a*, 4*b* do not terminate flush with the functional body 1, rather the edge region 7 of the contacts 4*a*, 4*b* is offset inward in comparison with the outer edge of the component. The contacts 4*a*, 4*b* are preferably arranged and formed in such a way that they completely contact the functional body 1 apart from the contact-free edge.

Figure 3:
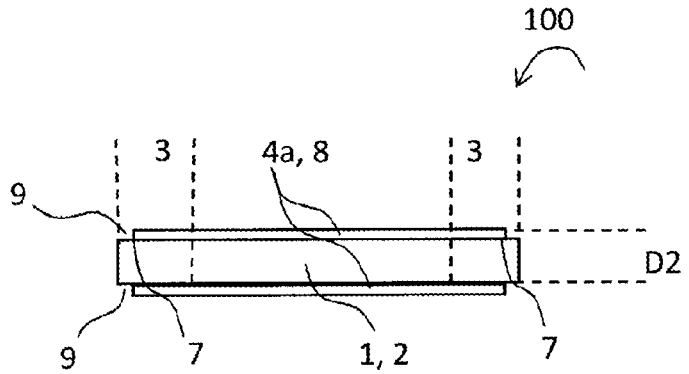
FIG. 3 shows a schematic sectional view of an electronic component according to the invention in accordance with an alternative embodiment.

FIG. 3 shows a schematic sectional view of the electronic component 100 in accordance with a further configuration according to the invention. It can be discerned in FIG. 3 that the functional region 2 has across its entire extent a constant thickness corresponding, for example, to the thickness D2 in FIG. 2. For the configuration according to the invention of the greater resistance of the first functional body portion 3 in comparison with the second functional body portion 2, here the material properties of the first and second functional body portions are preferably chosen to be different.

In order to decrease the electric current intensity and/or current density—for the same corresponding area—in the first functional body portion 3 during the operation of the electronic component 100, the first functional body portion 3 has a greater electrical resistivity than the second functional body portion 2. As a result of this configuration, analogously to the above embodiment with the increased thickness, as a result of the greater resistivity, it is possible to decrease a current density and thus the evolution of heat in the first functional body portion 3, in particular in or at the contact location with respect to the edge region 7.

The functional body 1 preferably comprises a sintered, polycrystalline material. In the case of a varistor component, the material is preferably silicon carbide, zinc oxide or some other metal oxide, such as bismuth oxide, chromium oxide or manganese oxide. In accordance with the configuration described here, the first functional body portion 3 is preferably produced or obtained by virtue of the fact that a starting material for the functional body 1 was for example sintered in such a way, or the composition of the starting material for the functional body was already chosen before sintering in such a way, that the first functional body portion 3 has a greater electrical resistivity in comparison with the second functional body portion 2. In the present case, this can be achieved by means of the formulation of the starting material and the sintering conditions, in particular the process conditions during sintering. A method for producing the functional body 1 for the electronic component 100 and/or the electronic component itself preferably comprises providing a green element or basic material 1 for the functional body 1, forming the functional body 1 using the basic material 1 in such a way that the electrical resistance of the functional body 1 in the first functional body portion 3 is greater than in the second functional body portion 2.

As described above, for this purpose the thickness D1 of the first functional body portion 3 is configured such that it is greater than the thickness D2 of the second functional body portion 2.

Alternatively or additionally, the basic material 1 can be sintered to form the functional body 1 in such a way that the electrical resistivity of the functional body 1 in the first functional body portion 3 is greater than in the second functional body portion 2. For this purpose, the basic material 1 can be exposed to a temperature gradient for example during sintering, without further material being added to the basic material 1 during sintering. Instead, the properties of the functional body 1 with regard to the electrical resistivity preferably form solely as a result of the formulation or composition for example on account of migration and/or diffusion processes of material constituents originally contained in the basic material 1.

In accordance with this configuration, the composition can comprise for example materials which preferably migrate into, diffuse into or accumulate in the first functional body portion 3 during sintering as a result of the temperature gradient described.

Alternatively or additionally, specific original materials of the basic material 1 can be withdrawn from the stoichiometry of the basic material 1 by evaporation out of the basic material 1 or evaporation from a surface of the basic material 1, in order thus to bring about a more inhomogeneous material composition in the functional body 1 in contrast to the basic body.

The described effects or processes can expediently have the consequence that crystal grains or the grain sizes thereof in the first functional body portion 3 of the functional body 1 are smaller or are made smaller than in the second functional body portion 2 and the electrical resistivity is thus increased in the first functional body portion 3 in contrast to the second functional body portion 2.

Alternatively, the basic material 1 can be provided with a dopant before sintering, which dopant diffuses into the basic material 1 for example during sintering in order to form the first functional body portion 3. The dopant can comprise or consist of, for example, yttrium oxide, in particular $Y_2O_3$, or other rare earth metals or oxides thereof. The dopant or the additional material is preferably applied to the basic material, or the basic material is dipped into the dopant or for example a solution or compound containing said dopant before sintering.

The configurations in FIGS. 2 and 3 can also be combined according to the invention by means of the described production method, for example, to the effect that both a greater thickness of the first functional body portion 3 in comparison with the second functional body portion and an altered material formulation or composition are present, as a result of which the described effects for reducing or decreasing the electric current density/evolution of heat in the first functional body portion 3 cumulate or are intensified.

Figure 4:
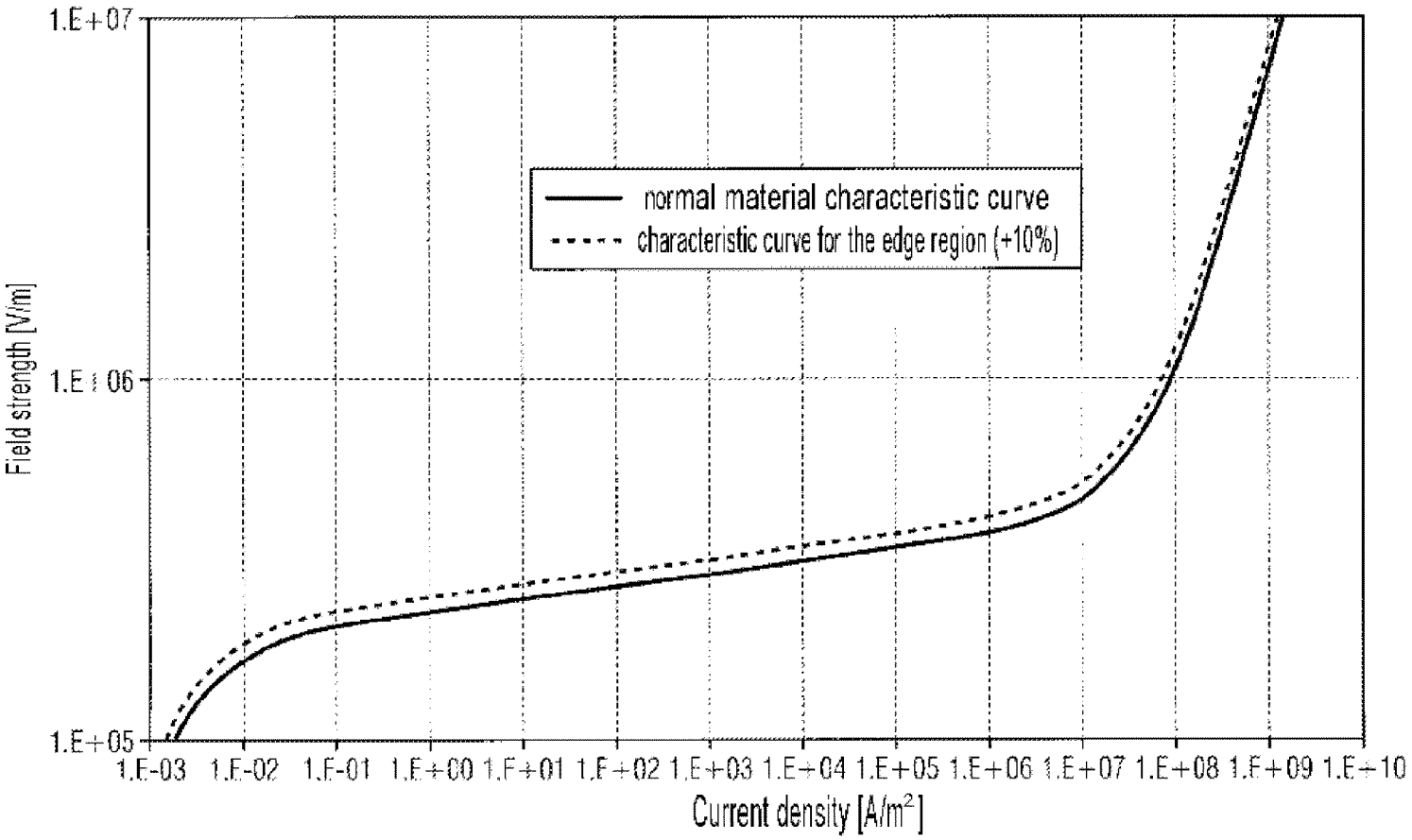
FIG. 4 shows an exemplary voltage-current characteristic curve of the electronic component embodied as a varistor component.

FIG. 4 shows an exemplary voltage-current characteristic curve of an electronic component according to the invention (dashed line) and an exemplary voltage-current characteristic curve of a conventional corresponding electronic component (solid line). Specifically, the electric field strength is plotted as a function of the electric current density on logarithmic scales. The characteristic curves preferably describe an operating range of the relevant components (cf. in particular the range above 10 A/mm$^2$).

The dashed voltage-current characteristic curve describes in particular the electrical behavior of a varistor component according to the invention, wherein the thickness of the abovementioned first functional body portion 3 (cf. FIG. 2, for example) is increased by 10% in comparison with the second functional body portion. The conventional varistor component here is preferably embodied identically or similarly to the component according to the invention, apart from the greater thickness described.

It can be discerned in FIG. 4, for example, that for a given electric field strength the electric current density of the component according to the invention in view of the logarithmic scale on the X-axis, at least in the central characteristic curve region having a flat profile, is significantly lower than in the case of the conventional varistor component.

FIGS. 5A to 5D show simulation results of the operation of varistor components according to the invention and conventional varistor components in accordance with the characteristic curve(s) from FIG. 4. The simulations preferably concern "finite element" (FEM) simulations. In particular, the electric current density and the temperature of the components or the temperature distribution in the components were simulated in each case under an electrical loading with a standard test pulse having the pulse shape 8/20 (μs) with a current intensity of 30 amperes at 25° C.

Figure 5A:
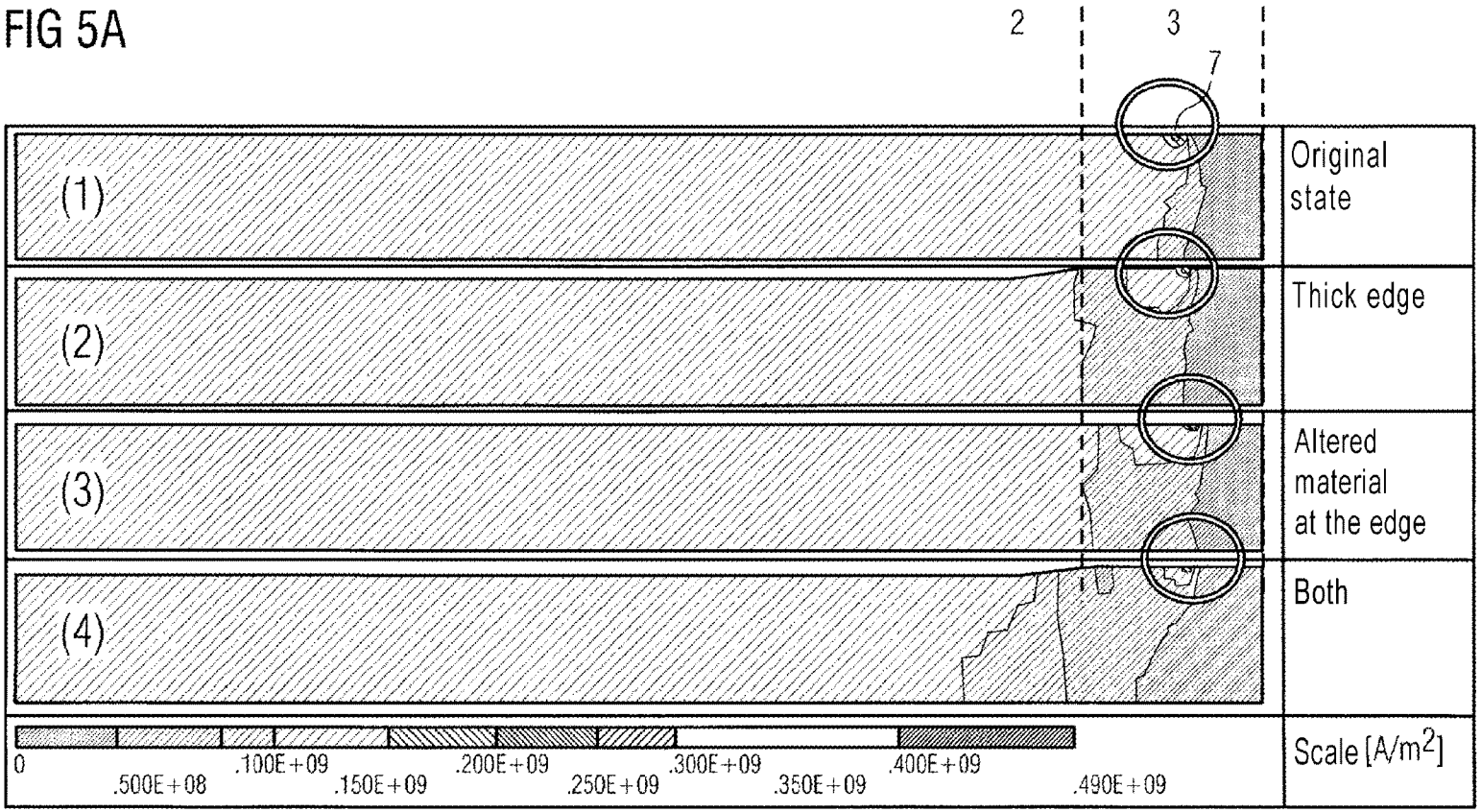
FIGS. 5A to 5D show simulation results of the operation of the electronic component.
Figure 5B:
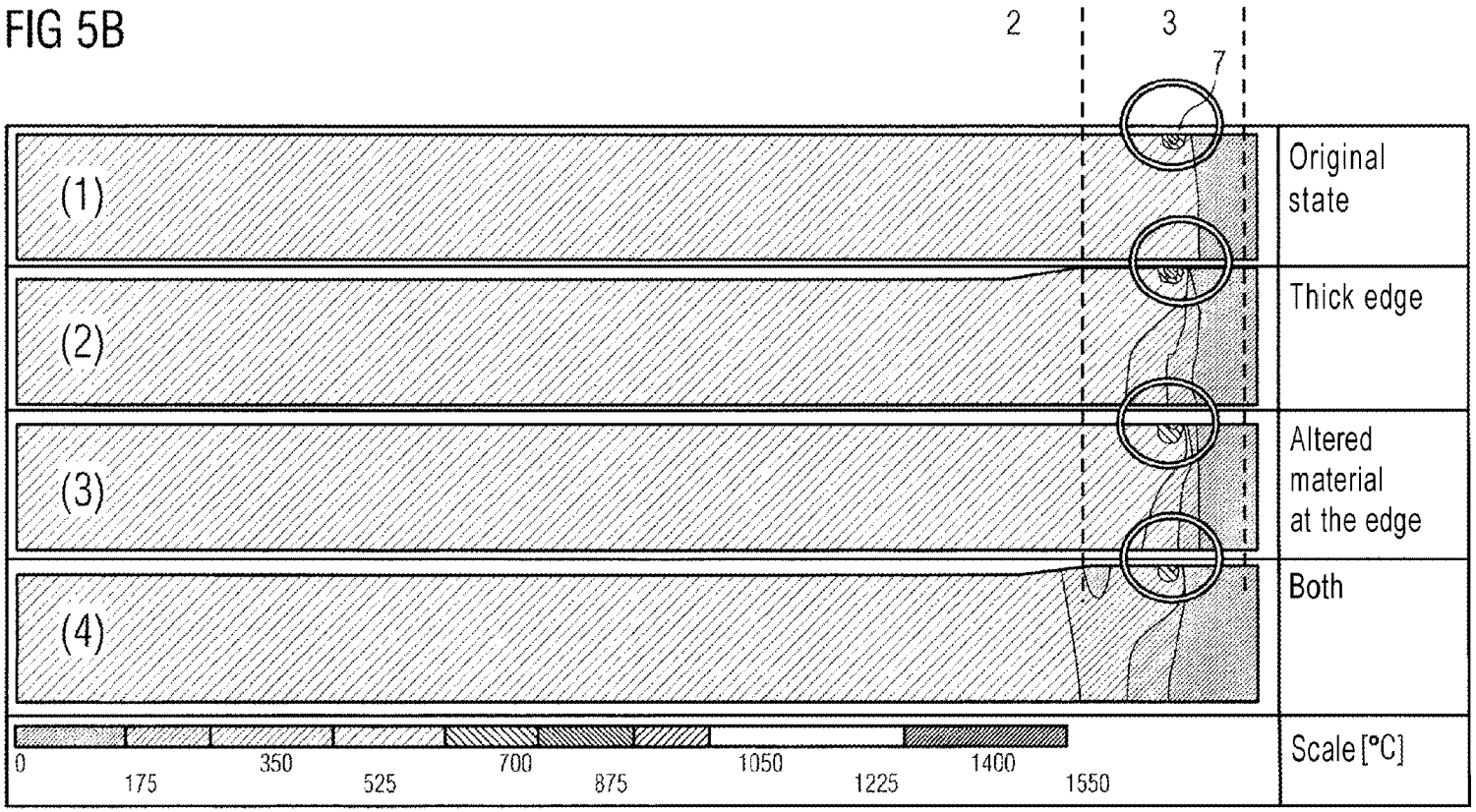

FIGS. 5A to 5D in each case describe four different geometries or partial figures of disk-type varistors (cf. numbering (1) to (4)), wherein at least in FIGS. 5A and 5B in each case approximately the right-hand half or a top right quarter of a sectional view is illustrated similarly or in a manner corresponding to FIGS. 2 and 3. The results concern disk-type varistors having a diameter of 30 mm and a thickness of a corresponding second functional body portion (cf. reference sign 2 above) of 3 mm. The vertical dashed lines in FIGS. 5A to 5D define the above-described first functional body portion of the respective components and visually demarcate said first functional body portion from the second functional body portion. At least the thickness of the first contact is 10 μm. The edge region 7 of the contacts (cf. reference sign 4*a* above) can be discerned in each case in the encircled regions.

The numberings (2) to (4) respectively correspond to configurations according to the invention, whereas number (1) respectively denotes the simulation of the conventional component, as described above.

Figure 5C:
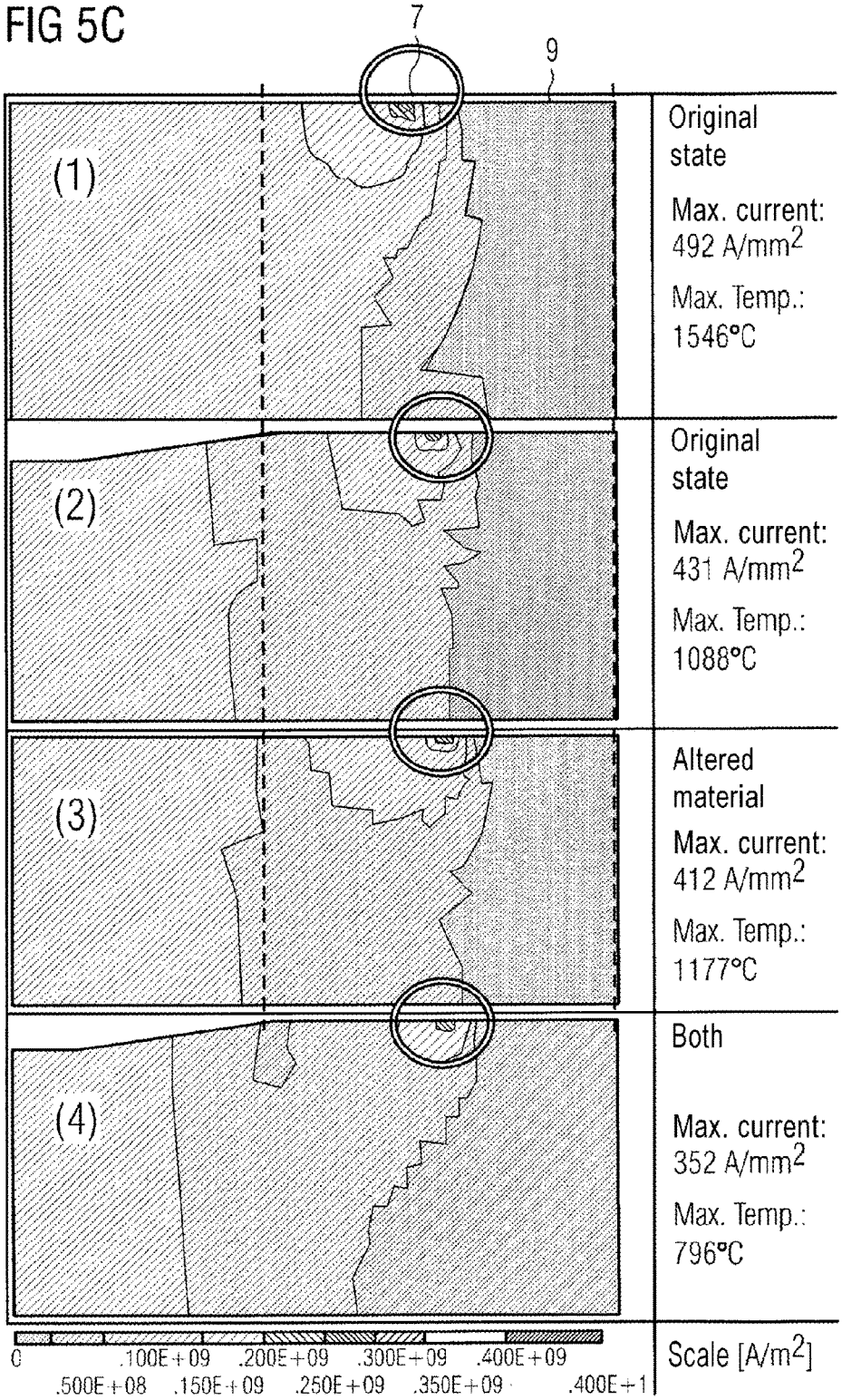
Figure 5D:
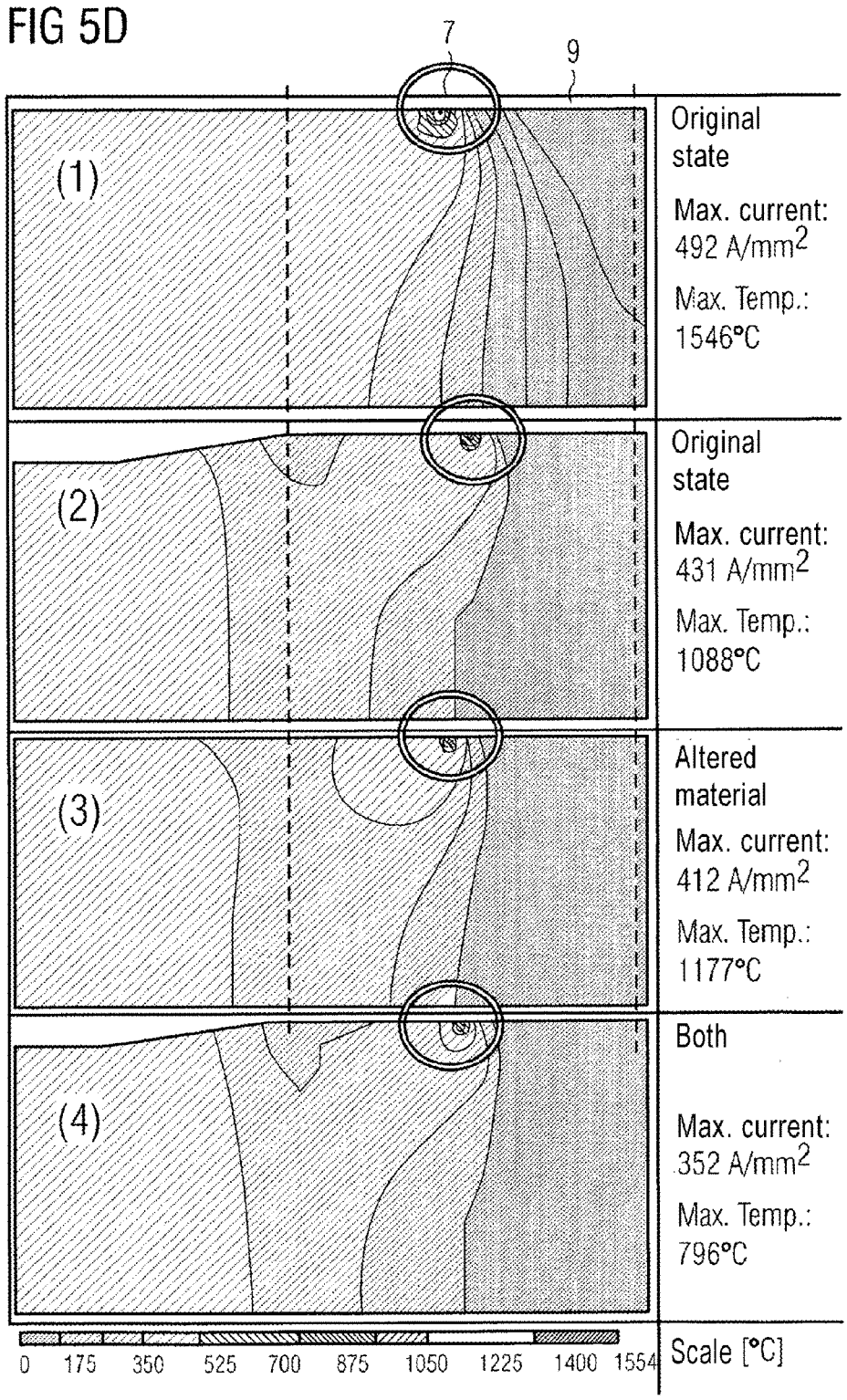

FIGS. 5A and 5C in each case show results for the electric current density in A/mm$^2$. FIGS. 5B and 5D in each case show results for the temperature in ° C. (cf. the corresponding color scales in the lower region of the respective figure).

In the partial figures (2) in accordance with the present invention in each case the thickness (cf. D1 in FIG. 2) of the first functional body portion is increased by 10% in comparison with the second functional body portion (see right-hand edge of the partial figures (2) in FIGS. 5A to 5D).

The partial figures (3) in each case show corresponding simulation results for the configuration of the device according to the invention in which, although the functional body portions are of identical thickness, the first functional body portion has a greater electrical resistivity than the second functional body portion on account of the material composition (FIG. 3 together with description).

The configurations of the partial figures (2) and (3) are combined in the partial figures (4), wherein in each case both a greater thickness of the first functional body portion and an electrical resistivity thereof increased by the material composition are shown and simulated.

It is evident at least to some extent in FIGS. 5A to 5D that the temperatures and respectively also the electric current densities in accordance with the color scales shown at the bottom in each case are distributed less uniformly in the first functional body portions 3 than in the second functional body portions 2. This is clarified in FIGS. 5C and 5D by the enlarged illustration in contrast to FIGS. 5A and 5B.

In particular at the edge regions 7 of the contacts or the contact locations of said edge regions 7 at or with respect to the functional bodies or first functional body portions (cf. encircled regions) both the temperature and the electric current density are significantly higher at points than in the corresponding rest of the functional body.

Under the conditions mentioned above, the temperature of the varistor component which arises as a reaction to the described test pulse in the first functional body portion, in particular in the vicinity of the edge region 7 of the contact, can be reduced by up to 750° C. according to the invention. Corresponding results of the electric current densities at the pulse maximum of the test pulse and the maximum temperature at the end of the pulse on the basis of numerical values are shown in the table in FIG. 6 for all the partial figures (1) to (4). Furthermore, the electrical voltage of the varistor is shown. While the voltage values for all simulated situations (partial figures) differ only slightly, for example temperature and also electric current density for the partial figures (4), that is to say for the combination of the configurations according to the invention from FIGS. 2 and 3, are significantly reduced in contrast to the partial figures (1) (cf. likewise the numerical values on the right in FIG. 5D).

The invention is not restricted by the description on the basis of the exemplary embodiments. Rather, the invention encompasses any novel feature and also any combination of features which in particular includes any combination of features in the patent claims, even if this feature or this combination itself is not explicitly specified in the patent claims or exemplary embodiments.

LIST OF REFERENCE SIGNS

1 Functional body/Basic material
2 Second functional body portion
3 First functional body portion/Portion of the basic material
4*a* First contact
4*b* Second contact
5 First surface
6 Second surface
7 Edge region
8 Central region
9 Contact-free region
100 Electronic component
D1, D2 Thickness
R1, R2 Radial extent

The invention claimed is:

1. An electronic component comprising:

a functional body comprising a first surface and a second surface, wherein the second surface faces away from the first surface; and a first contact electrically linked to the first surface, the first contact having an edge region and a central region, wherein the functional body has a first electrical resistance between the first surface and the second surface in a first functional body portion, which overlaps the edge region of the first contact as viewed in a plan view of the electronic component, that is greater than a second electrical resistance between the first surface and the second surface in a second functional body portion, which overlaps the central region of the first contact as viewed in the plan view of the electronic component, and wherein the functional body has a greater electrical resistivity in the first functional body portion than in the second functional body portion.

2. The electronic component according to claim 1, wherein the first functional body portion extends at least partly circumferentially around the second functional body portion as viewed in the plan view of the electronic component.

3. The electronic component according to claim 1, wherein a surface area of the second functional body portion as viewed in the plan view of the electronic component is greater than a surface area of the first functional body portion.

4. The electronic component according to claim 1, wherein the functional body has, in the first functional body portion, a contact-free region, in which the first contact is not electrically linked to the functional body.

5. The electronic component according to claim 1, wherein a thickness of the functional body in the first functional body portion is greater than a thickness of the functional body in the second functional body portion.

6. The electronic component according to claim 5, wherein the thickness of the functional body in the first functional body portion is 5% to 15% greater than the thickness of the functional body in the second functional body portion.

7. The electronic component according to claim 1, further comprising a second contact electrically linked to the second surface of the functional body, wherein the functional body is configured to homogenize a current density distribution in case of a current flows in the functional body between the first and second contacts in the first and second functional body portions.

8. The electronic component according to claim 1, wherein the electronic component is a varistor component.

9. The electronic component according to claim 1, wherein the functional body comprises a polycrystalline material.

10. A method for producing a functional body for an electronic component, the method comprising:

providing a basic material for the functional body for the electronic component; and forming the functional body using the basic material such that an electrical resistance of the functional body, measured between two opposite surfaces, in a first functional body portion is greater than in a second functional body portion, and wherein forming the functional body comprises sintering the basic material such that an electrical resistivity of the functional body in the first functional body portion is greater than an electrical resistivity in the second functional body portion.

11. The method according to claim 10, wherein the basic material has a more homogeneous material composition than the functional body.

12. The method according to claim 10, wherein the basic material is formed with a greater thickness in the first functional body portion than in the second functional body portion.

13. The method according to claim 10, wherein a material composition of the basic material is altered in a first portion while sintering in order to form the first functional body portion.

14. The method according to claim 10, wherein the basic material is exposed to a temperature gradient while sintering, and wherein the basic material is not provided with material additives while sintering.

15. The method according to claim 10, wherein the basic material is doped with a dopant before sintering, the dopant diffuses into the basic material during sintering in order to form the first functional body portion.

16. An electronic component comprising a functional body and a contact which is electrically linked to a first surface of the functional body, wherein the contact has an edge region and a central region, wherein the functional body is configured such that an electrical resistance of the functional body between the first surface and a second surface of the functional body, the second surface facing away from the first surface, in a first functional body portion, which overlaps the edge region as viewed in a plan view of the electronic component, is greater than in a second functional body portion, which overlaps the central region of the contact as viewed in a plan view of the electronic component, and wherein the functional body is configured such that the first functional body portion has a greater electrical resistivity in comparison with the second functional body portion.

* * * * *